United States Patent [19]

Guiler

[11] 4,254,977

[45] Mar. 10, 1981

[54] SECURITY SEAL OF THE PADLOCK TYPE WITH TAMPER INDICATING PROTRUSIONS

[75] Inventor: Richard S. Guiler, Stewartsville, N.J.

[73] Assignee: E. J. Brooks Company, Newark, N.J.

[21] Appl. No.: 48,029

[22] Filed: Jun. 13, 1979

[51] Int. Cl.[3] ..... B65D 33/34

[52] U.S. Cl. ..... 292/320

[58] Field of Search ..... 292/307 R, 316–322; 24/16 PB

[56] References Cited

U.S. PATENT DOCUMENTS

| | | | |
|---|---|---|---|
| 3,485,521 | 12/1969 | Moberg | 292/320 |
| 3,838,878 | 10/1974 | Fernberg et al. | 292/318 |

*Primary Examiner*—Richard E. Moore

*Attorney, Agent, or Firm*—Robert E. Ross

[57] ABSTRACT

A seal of the type resembling a padlock which comprises a plastic housing having a pair of apertures in the top surface for receiving the ends of a wire shackle. To provide evidence of tampering, by attempts to work a shackle end out of an aperture with a pair of pliers or the like, upwardly extending protuberance are provided on the upper surface of the body, which are mashed down by the tool being used in an attempt to open the seal, thereby giving evidence of tampering. When certain types of colored plastic are used for the seal body, the deformation of the protuberance causes them to turn white, giving further evidence of tampering.

7 Claims, 8 Drawing Figures

SECURITY SEAL OF THE PADLOCK TYPE WITH TAMPER INDICATING PROTRUSIONS

BACKGROUND OF THE INVENTION

In my U.S. Pat. No. 3,485,521 there is illustrated a seal of the padlock type, in which the body is formed of a synthetic organic plastic with a pair of apertures opening to one end of the body, and the shackle is formed of a U-shaped piece of wire having reverse bent end portions, which end portions, when inserted into the body openings, are locked therein by the end portion being maintained in a flexed condition so that the end of the reverse bent portion digs into the wall of the housing aperture.

Although the seal as illustrated in the above-identified patent has achieved considerable commercial success, it has been found that in some instances it has been possible to work an end of the shackle out of its aperture to enable the seal to be removed and re-assembled without leaving evidence of tampering.

SUMMARY OF THE INVENTION

A seal of the type resembling a padlock, as shown in the above-identified patent, is provided with protuberances on the top surface of the body, which will be deformed when unauthorized attempts are made to open the seal by prying one of the shackle wires out of a body aperture, thereby giving evidence of tampering. In one modification of the invention, the protuberances are a series of separate conical projections. In another modification, the protuberances are a pair of elongated projections, which may have a generally triangular cross-section extending along the top surface of the body on both sides of the shackle apertures.

DESCRIPTION OF THE ILLUSTRATED EMBODIMENT

Figure 1:
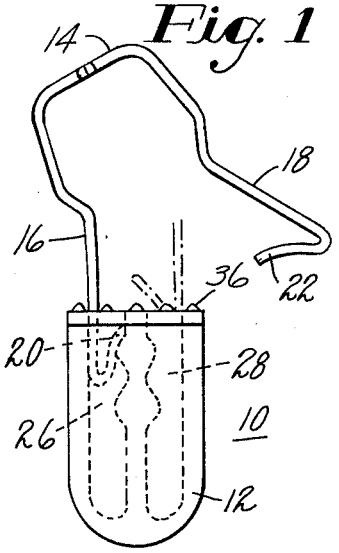
FIG. 1 is a view in side elevation of a seal having one form of tamper indicating protuberances on the upper surface of the body.
Figure 2:
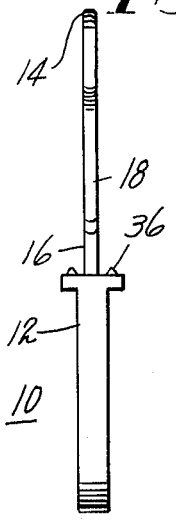
FIG. 2 is a view of the seal of FIG. 1 partly broken away as seen from the right side.
Figure 3:
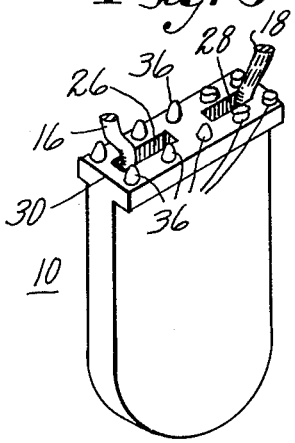
FIG. 3 is a perspective view of the seal of FIG. 1 partly broken away, with the shackle assembled with the seal body.

Referring to the drawing there is illustrated a seal 10, comprising a housing or body 12 formed of synthetic organic plastic such as polypropylene, and a shackle 14 formed of spring wire, which is generally U-shaped to provide a pair of legs 16 and 18 the ends of which have reversely bent end portions 20 and 22. As described in the above-identified patent, the length and angle of the end portions 20 and 22 are such in relation to the size of apertures 26 and 28 opening to the upper end 30 of the body that when a shackle end is inserted into a body aperture, the bent end is maintained in a flexed condition in the aperture so that the extreme end of the reversely bent end portions (20 or 22) digs into the aperture wall to prevent removal of the shackle. Notches 32 may be provided in the aperture wall to assist in enabling the reversely bent ends to dig into engagement with the wall.

The usual method used by an unauthorized person to remove a shackle leg from the housing of the seal of the type described in the above-identified patent is by grasping the housing with one hand, and grasping a shackle leg at the top surface of the housing with a pair of pliers such as 34. By manipulation of the pliers, it is sometimes possible to work the shackle end out of the housing, or to cause the shackle end to pierce the housing so the exposed end can be cut off.

To provide readily noticeable visual means that an attempt has been made to open the seal a series of individual protuberances 36 are provided on the upper surface of the body. In the illustrated embodiment, the protuberances are generally conical in shape, and are disposed in two rows along the top of the body on opposite sides of the apertures 26 and 28.

Figure 4:
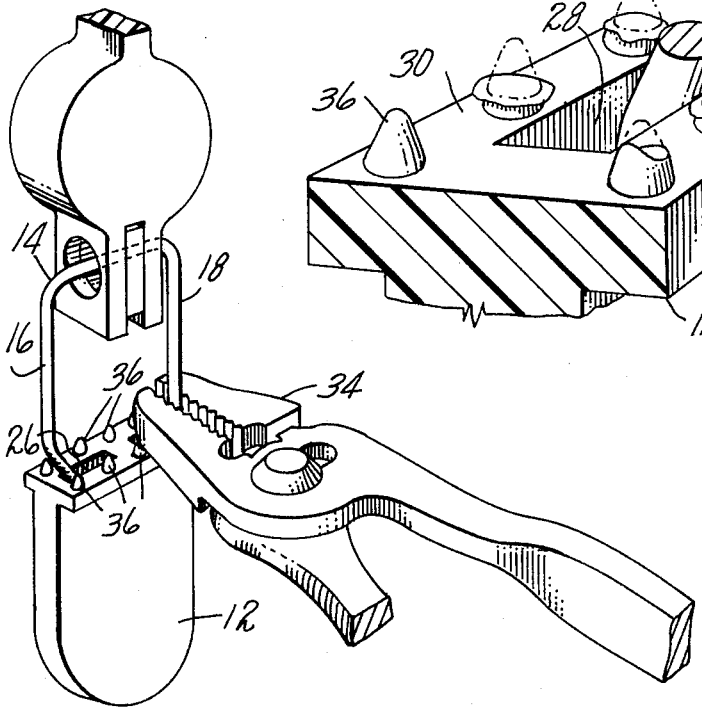
FIG. 4 is a view of a seal of the type shown in FIG. 1 assembled with an article to be protected, illustrating one manner in which attempts are made to remove a shackle leg from a seal body opening.

In an attempt to remove a shackle from its opening by pliers as illustrated in FIG. 4, the shackle is grasped as near the body as possible and twisted sideways so that the pliers are forced against the body, to apply tension to the shackle leg.

Figure 5:
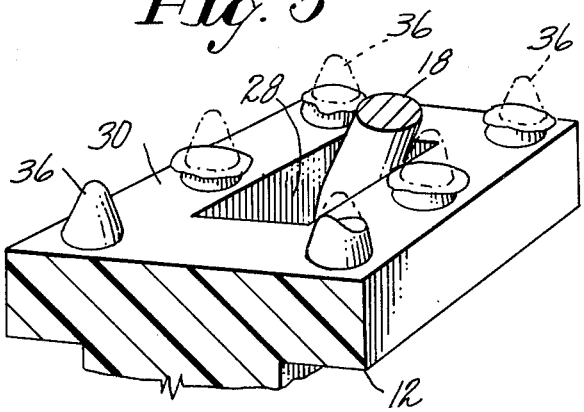
FIG. 5 is an enlarged perspective view of the seal of FIG. 4 with portions omitted for clarity, after an attempt has been made to open the seal in the manner shown in FIG. 4, illustrating the deformation of the tamper protuberance.

The working of the pliers back and forth in this manner inevitably deforms one or more of the protuberances 36 as illustrated in FIG. 5, thereby providing a visual indication that an attempt has been made to tamper with the seal, whether said attempt is successful or unsuccessful.

The use of certain types of plastic, such as pigmented polypropylene will provide further evidence of tampering in that when such plastic is permanently physically deformed a substantial amount, as are the protuberances 36, a portion or all of the deformed surface will turn white, and hence stand out in contrast to the surrounding colored surface. Hence when the protuberances 36 are deformed at least a portion of the mashed upper surface will have white portions that are readily visible to an inspector.

Figure 6:
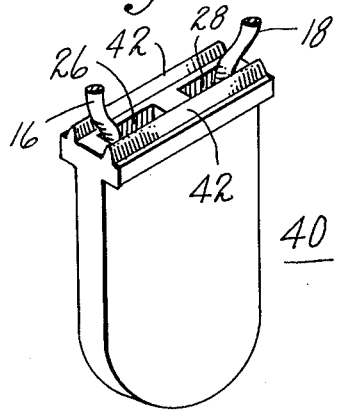
FIG. 6 is a perspective view of a seal of the type illustrated in FIGS. 1–5, having a modified form of tamper indicating protuberance on the top surface.
Figure 7:
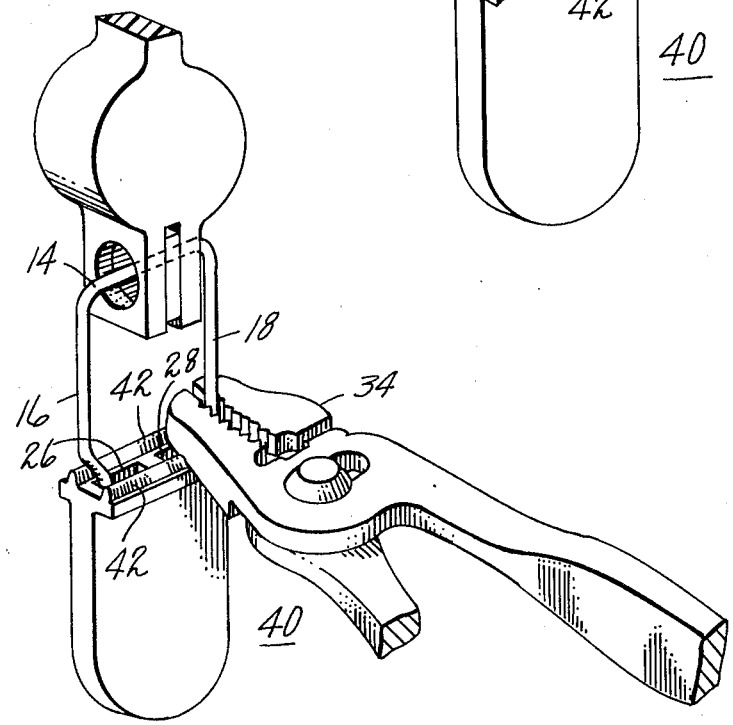
FIG. 7 is a view of the seal of FIG. 6 assembled with an article to be protected illustrating a method of attempting to open the seal.
Figure 8:
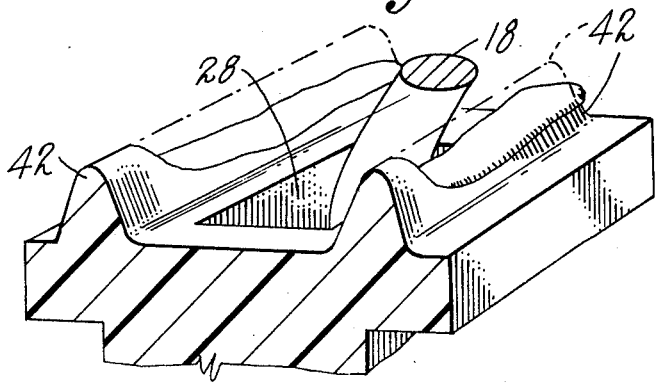
FIG. 8 is an enlarged view of a portion of the top of the seal of FIG. 7 after an opening attempt as shown in FIG. 7 has been made, illustrating the deformation of the tamper indicating protuberances.

Referring now to FIGS. 6–8, there is illustrated a modified form of seal 40 embodying the features of the invention. The seal 40 may be identical to the seal 10 previously described; however, instead of individual protuberances, two continuous upwardly protuberances in the form of ribs 42 are provided on the upper surface of the body, on opposite sides of the openings.

As illustrated in FIGS. 7 and 8, the ribs serve the same function as the protuberances 36 on the seal 10, in that the top of one or both ribs is mashed down by the pliers when an attempt is made to work a shackle leg out of its opening in the seal body. If pigmented plastic of the proper type is used, white portions will also be formed on the deformed upper surface of the rib.

Although in the illustrated embodiment the protuberances 36 are conical and the protuberances 42 are generally triangular in cross-section, it will be apparent that the protuberances may have other shapes. For example, the individual protuberances may be small upstanding cylinders, and the continuous protuberances may be thin upstanding web members.

Since other changes apparent to one skilled in the art may be made in the illustrated embodiments of the invention, it is intended that all matter contained herein be interpreted in an illustrative and not a limiting sense.

I claim:

1. A seal of the type resembling a padlock and comprising a plastic housing having a cavity opening to a surface thereof for receiving the leg of a wire shackle, and protuberances projecting from said surface adjacent said openings in position to be deformed by a tool used in an attempt to work the shackle leg out of the opening.

2. A seal as set out in claim 1 in which the housing is made of a form of pigmented plastic that forms a white surface when physically deformed a substantial amount.

3. A seal as set out in claim 1 in which said surface of the housing has a plurality of individual protuberances.

4. A seal as set out in claim 1 in which said surface has a pair of elongated protuberances disposed at opposite sides of the opening.

5. A seal of the type resembling a padlock and comprising a plastic housing having an upper surface with a pair of spaced openings extending into the body for receiving the ends of shackle legs, and series of individual protuberances extending upwardly from the upper surface, said protuberances being disposed along said surface in two rows disposed on opposite sides of said openings.

6. A seal of the type resembling a padlock and comprising a plastic housing having an upper surface with a pair of spaced openings extending into the body for receiving the ends of shackle legs, and an upwardly extending protuberance in the form of an elongated rib disposed on the upper surface of the body on opposite sides of the apertures, said rib having a transverse dimension at the top which is small enough to be readily deformed by a tool used in an attempt to work the shackle leg out of the opening, said housing being formed of a pigmented plastic of the type that changes surface color when the surface is physically deformed.

7. A seal body for a seal of the type in which an end of a wire shackle is received in a body cavity in locking engagement, said body being formed of pigmented plastic of the type that changes surface color when said surface is physically deformed, said body having an opening for receiving a shackle end in locking engagement and upwardly extending protuberances so positioned about said opening and having upper surfaces with sufficiently small area to enable said upper surfaces to be readily deformed by a tool used in an attempt to work the shackle leg out of the opening.

* * * * *